US005998916A

United States Patent [19]

Kim

[11] Patent Number: 5,998,916

[45] Date of Patent: Dec. 7, 1999

[54] FIELD EMISSION DEVICE RESISTORS AND METHOD FOR FABRICATING THE SAME

[75] Inventor: Jong-min Kim, Yongin, Rep. of Korea

[73] Assignee: Samsung Display Devices Co., Ltd., Kyungki-do, Rep. of Korea

[21] Appl. No.: 09/038,050

[22] Filed: Mar. 11, 1998

[51] Int. Cl.[6] ..... H01J 1/05

[52] U.S. Cl. ..... 313/310; 313/309; 313/495

[58] Field of Search ..... 313/309, 310, 313/336, 351, 495

[56] References Cited

U.S. PATENT DOCUMENTS 5,786,659 7/1998 Takagi et al. ..... 313/310

*Primary Examiner*—Vip Patel

*Attorney, Agent, or Firm*—Kile, McIntyre, Harbin & Lee; Eugene M. Lee

[57] ABSTRACT

A field emission device in which resistors are used and a method for fabricating the same are provided. The resistor layer is formed by depositing diamond like carbon (DLC) on the cathodes by the PECVD method in the field emission device using the resistor according to the present invention. Accordingly, fabrication yield is high since the adhesion of the resistor layer to the cathodes is improved. Various types of resistor layers can be formed since the resistor layer has excellent chemical durability. The reliability and consistency of the fabrication process is improved since the doping level is easily controlled.

13 Claims, 7 Drawing Sheets

FIELD EMISSION DEVICE RESISTORS AND METHOD FOR FABRICATING THE SAME

BACKGROUND OF THE INVENTION

1. Field of the Invention

The present invention relates to a field emission device using resistors and a method for fabricating the same.

2. Description of the Related Art

FIG. 1 is a sectional view of a field emission device using resistors. FIG. 2 is a perspective view of a field emission device using resistors. As shown in FIGS. 1 and 2, in a conventional field emission device using resistors, a plurality of cathodes 2 are formed on a rear substrate 1. Resistor layers 3 are formed on the cathodes 2. A plurality of microtips 2' are formed on the resistors 3 in an array pattern. The microtips 2' are formed in holes 4*a* of an insulating layer 4 formed on the cathodes 2. Gates 5 having openings 5*a* corresponding to the holes 4*a* are stacked on the insulating layer 4. Here, amorphous silicon or a heat-resistant cermet such as Cr—$SiO_2$ is generally used as a material of the resistor layer 3.

FIG. 3 is a sectional view of a field emission device using general resistors, having another structure. FIG. 4 is a perspective view of a field emission device using general resistors having a structure different from the structure of the field emission device of FIG. 1. The field emission device shown in FIGS. 3 and 4 is different from the device shown in FIGS. 1 and 2 in that resistors 13 are not entirely stacked on cathodes 12 but partially stacked on the cathodes 12 arranged in holes 14*a* of an insulating layer 14 and that microtips 12' are formed on the local resistors 13. A substrate 11, the cathodes 12, the insulating layer 14, and gates 15 shown in FIGS. 3 and 4 are slightly different from those of FIGS. 1 and 2.

As shown in a stabilized gate voltage (Vg)-current (I) characteristic curve such as the curve (B) of FIG. 5, the above-mentioned field emission devices using general resistors can be protected from excessive current, thus having a longer life in an wide operation area in which an electron emission (a flow of current) is generated. Namely, according to a gate voltage-current characteristic of a general field emission device in which resistors are not used, electron emission rapidly increases as a gate voltage increases as shown in the curve A. However, in the case of the field emission device using resistors, the electron emission is slow according to the increase of the gate voltage. Accordingly, a slow gate voltage-current characteristic curve such as the curve B is obtained.

However, the field emission device using the amorphous silicon or the heat-resistant cermet such as Cr—$SiO_2$ as the material of the resistor layers 3 and 13 has the following problems. First, resistor layers 3 and 13 have poor adhesion to the cathodes 2 and 12, thus complicating the fabrication processes.

Second, the resistor layers 3 and 13 are easily eroded by $HNO_3$ base in a process of removing an Al sacrificial layer (not shown) during the formation of the microtips 2' and 12', thus complicating the fabrication processes. Third, a doping level is hard to stabilize in the resistor layers 3 and 13. Accordingly, the reliability and reproducibility of the fabrication process is deteriorated. Fourth, electron-beam deposition and a sputtering method are used for forming Cr—$SiO_2$ resistor layers. However, the doping level is hard to control and the fabrication process is complicated.

SUMMARY OF THE INVENTION

To solve the above problems, it is an objective of the present invention to provide a field emission device using resistors having good adhesion to cathodes, excellent chemical-durability, and a simple fabrication process such as a low temperature process. It is another objective of the present invention to provide a method for fabricating such a field emission device.

Accordingly, to achieve the first objective, there is provided a field emission device in which resistors are used, the field emission device comprising a substrate, cathodes formed on the substrate, a resistor layer continuously formed on the cathodes, microtips formed on the resistor layer, an insulating layer formed on the resistor layer and the substrate, including holes corresponding to the microtips, which are spaced from the microtips and surround the microtips, and a gate formed on the insulating layer so as to have openings corresponding to the holes, wherein the resistor layer is formed of diamond like carbon (DLC).

In the present invention, the DLC preferably has a resistivity of $10^3\Omega\cdot cm$–$10^{11}\Omega\cdot cm$. Also, it is preferable that the resistor layer is discontinuously and locally formed on the cathodes so as to form the lower end columns of the microtips.

In accordance with another object of the invention, there is provided a method for fabricating the field emission device in which resistors are used, comprising the steps of (a) forming cathodes on a substrate, (b) forming a continuous resistor layer by depositing DLC on the cathodes, (c) forming an insulating layer and a gate layer by sequentially depositing an insulating material and a gate material on the exposed substrate and respectively forming a plurality of holes and openings in the insulating layer and the gate layer formed on the cathodes, (d) forming microtips by forming a split layer on the gate and the exposed insulating layer and by depositing a material for forming microtips on the exposed cathodes to a predetermined thickness, and (e) removing the unnecessary material for forming microtips deposited in the step (d) by lifting off the split layer.

In the present invention, the DLC preferably has a resistivity of $10^3\Omega\cdot cm$–$10^{11}\Omega\cdot cm$ by doping with $PH_3$ in the step (b).

In accordance with another object of the invention, there is provided a method for forming a field emission device in which other resistors are used, comprising the steps of (a) forming cathodes on a substrate, (b) forming a resistor layer by depositing DLC on the cathodes, (c) forming a microtip layer by depositing a material for forming microtips on the exposed substrate and resistor layer, (d) forming a mask for forming microtips on the microtip layer, (e) forming a pointed head of the microtip by isotropic etching the microtip layer using the mask for forming microtips, (f) forming a column of the microtip and a resistor layer corresponding to the column by sequentially anisotropic etching the microtip layer and the resistor layer using the mask, (g) forming a gate by forming an insulating layer and a gate layer by sequentially depositing an insulating material and a gate material on the cathodes and the substrate, exposed in the step (f) and patterning the gate layer, (h) removing the unnecessary insulating material and gate material, deposited on the step (g) by a lift off method used for removing the mask for forming microtips, and (i) forming holes of the insulating layer, using the gate as a mask.

In the present invention, the DLC preferably has a resistivity of $10^3\Omega\cdot cm$–$10^{11}\Omega\cdot cm$ by doping with $PH_3$ in the step (b). These and other objects of the invention will be readily apparent upon review of the detailed description that follows.

BRIEF DESCRIPTION OF THE DRAWING(S)

The above objectives and advantages of the present invention will become more apparent by describing in detail a preferred embodiment thereof with reference to the attached drawings in which.

FIGS. 6 through 10 are sectional views showing states after processes of fabricating an embodiment of a field emission device using resistors according to an embodiment of the present invention are performed; and FIGS. 11 through 15 are sectional views showing states after processes of fabricating another embodiment of a field emission device using resistors according to the present invention are performed.

DESCRIPTION OF THE PREFERRED EMBODIMENT(S)

Hereinafter, a field emission device using resistors according to the present invention and a method for fabricating the same will be described with reference to the attached drawings.

Figure 1:
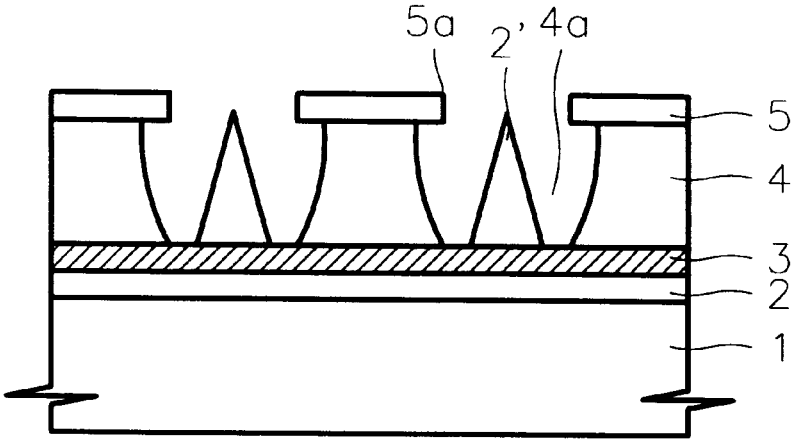
FIG. 1 (PRIOR ART)
FIG. 1 is a sectional view of a general field emission device using resistors.
Figure 3:
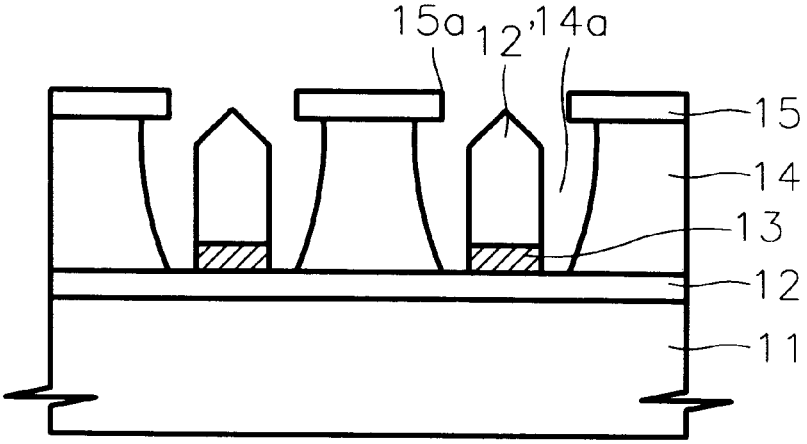
FIG. 3 (PRIOR ART)
FIG. 3 is a sectional view of another type of general field emission device using resistors.
Figure 2:
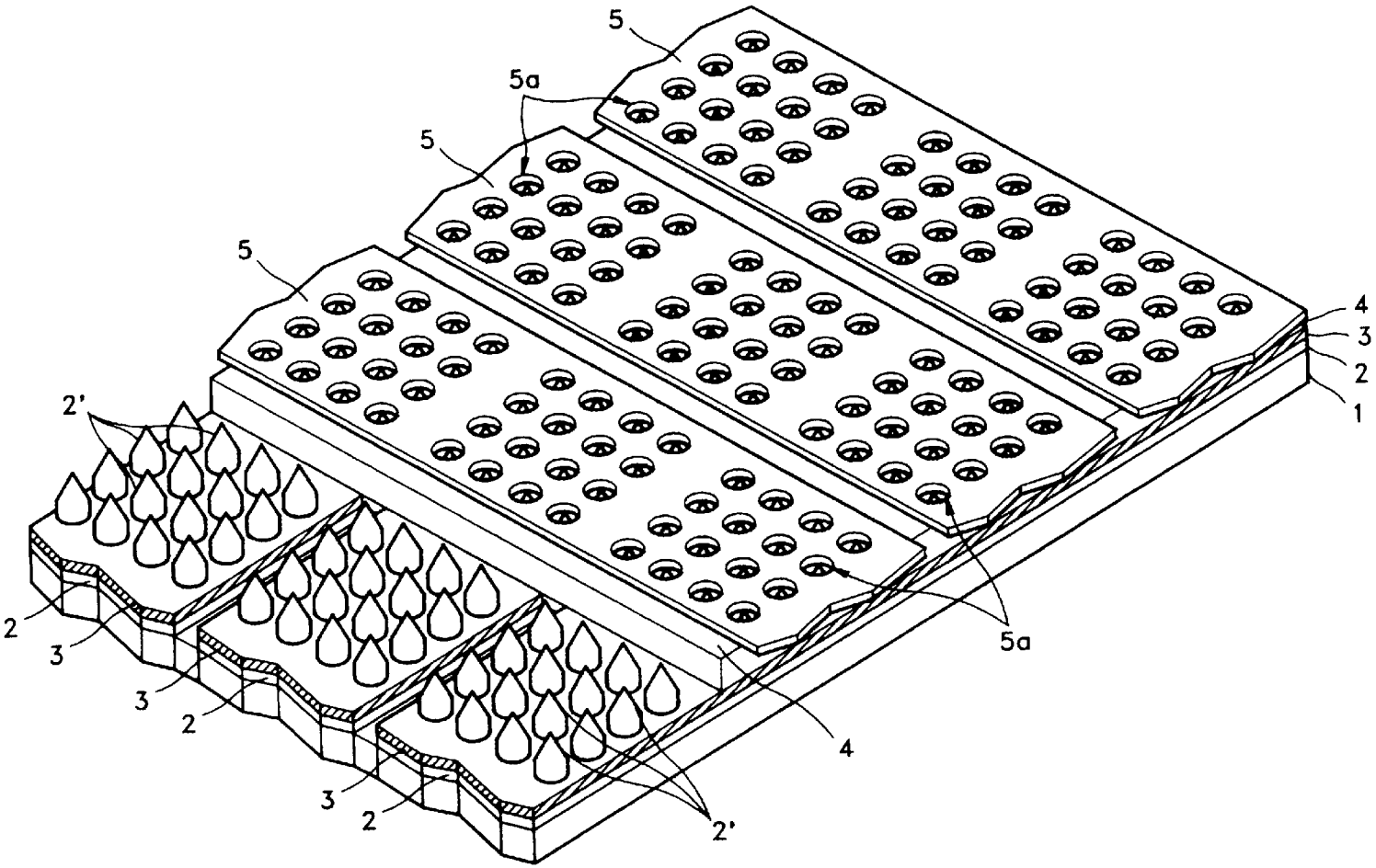
FIG. 2 (PRIOR ART)
FIG. 2 is a perspective view of the field emission device of FIG. 1.
Figure 4:
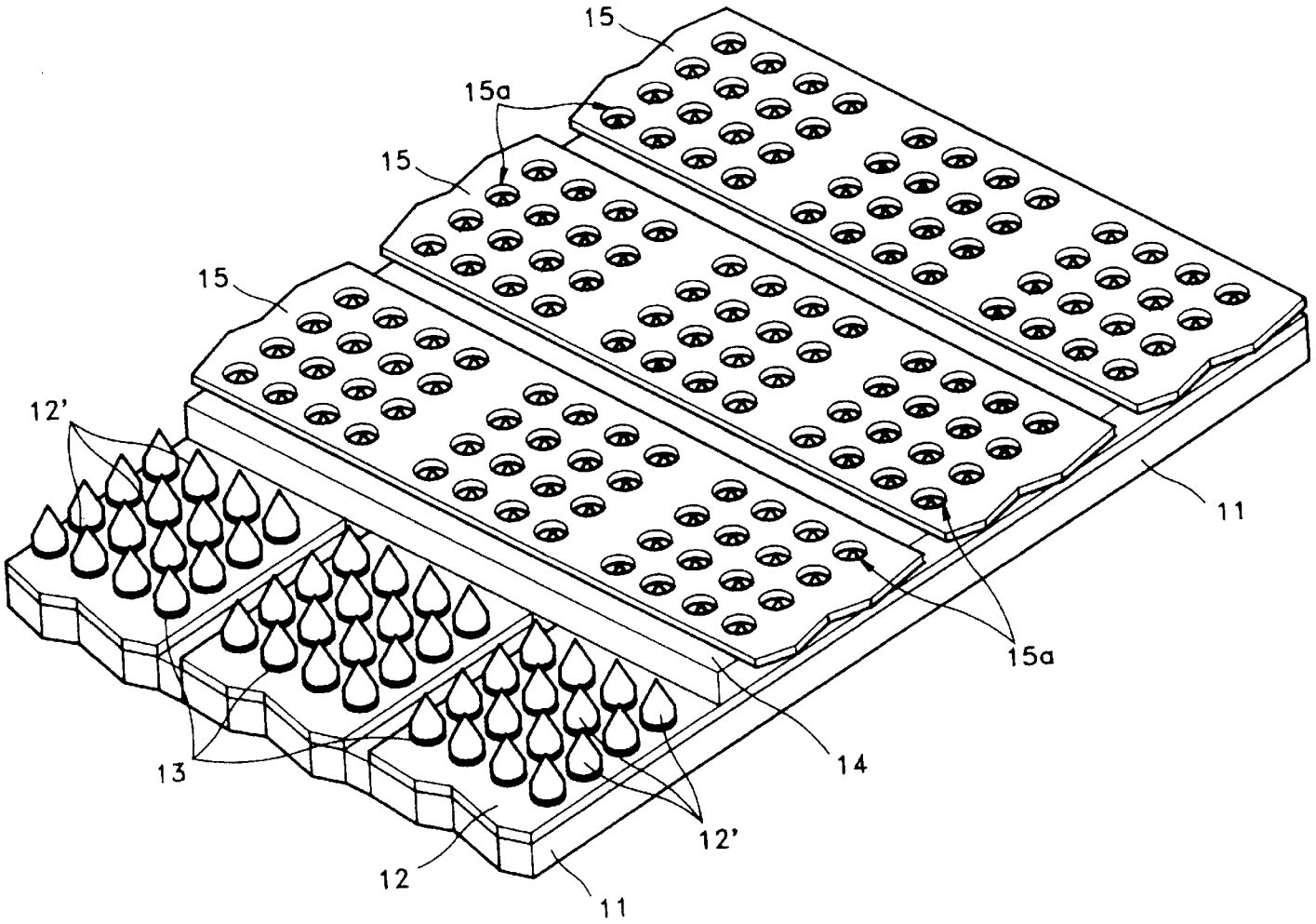
FIG. 4 (PRIOR ART)
FIG. 4 is a perspective view of a field emission device of FIG. 3.
Figure 5:
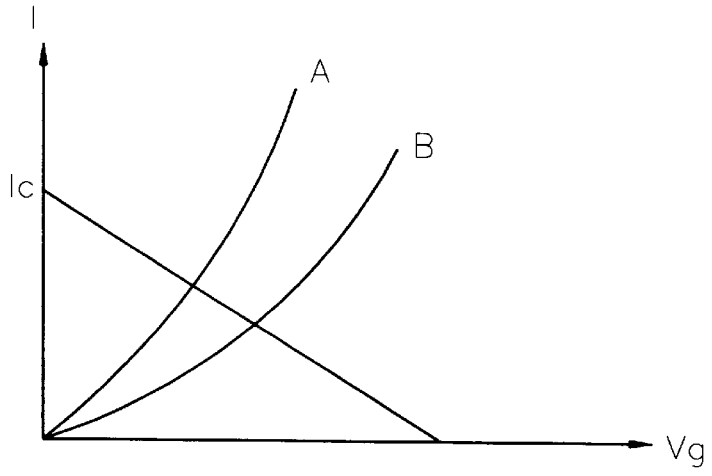
FIG. 5 shows gate voltage-current characteristic curves of a field emission device which does not have a resistor layer and a field emission device using resistors of FIGS. 1 and 2.

Diamond-like carbon (DLC) is used as a resistor in the field emission device using the resistor according to the present invention. Those skilled in the art recognize that diamond-like carbon (DLC) is a known; material and can be obtained from a variety of sources. Namely, a device of a stabilized operation characteristic, having a stable gate voltage-current characteristic curve, as shown in the curve B of FIG. 5, is obtained by replacing a resistor layer 3 formed of amorphous silicon or a heat-resistant cermet such as Cr—$SiO_2$ of a field emission device having the structure shown in FIG. 1 or a resistor layer 13 formed of amorphous silicon of a field emission device having a structure shown in FIG. 3 by the DLC. Therefore, the field emission device according to the present invention has a structure similar to that of the field emission device shown in FIGS. 1, 2, 3, and 4. The field emission device according to the present invention is different from the field emission device shown in FIGS. 1, 2, 3, and 4 in that resistor layers 3' and 13' are formed of the DLC which preferably is doped with $PH_3$ thus forming a resistor having a resistivity of $10^3\Omega\cdot cm$–$10^{11\Omega\cdot cm}$.

Methods for fabricating a first embodiment and a second embodiment of the field emission device using the resistor of the above structure are as follows.

Figure 6:
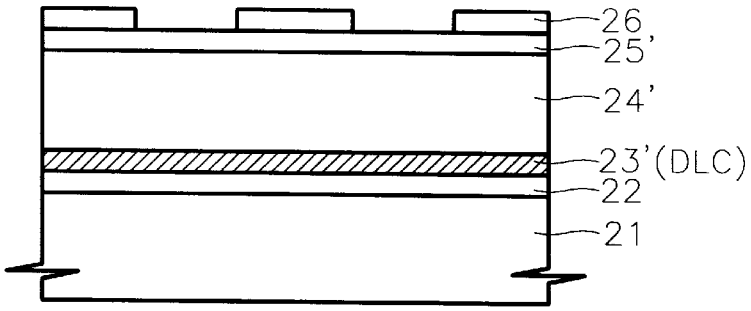

In the first embodiment, as shown in FIG. 6, cathodes 22 in strips are formed on a substrate 21. A resistor layer 23' formed of the DLC, an insulating layer 24, and a gate material layer 25' are sequentially stacked on the cathodes 22. A photoresist mask 26 for forming an opening is formed on the gate material layer 25'. At this time, the DLC preferably is deposited by a plasma enhanced chemical vapor deposition (PECVD). Accordingly, the resistor layer 23' has better adhesion to the cathodes 22. The DLC resistor layer 23' also preferably is doped with $PH_3$ and thus becomes a resistor having a resistivity of $10^3\Omega\cdot cm$–$10^{11}\Omega\cdot cm$.

Figure 7:
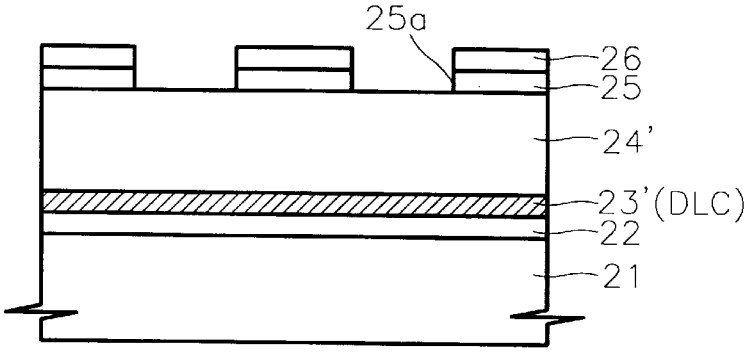

As shown in FIG. 7, a gate 25 having an opening 25*a* is formed by anisotropically etching the gate layer 25' using photolithography in which the photoresist mask 26 is used. At this time, a reactive ion etching (RIE) method is used for the anisotropic etching.

Figure 8:
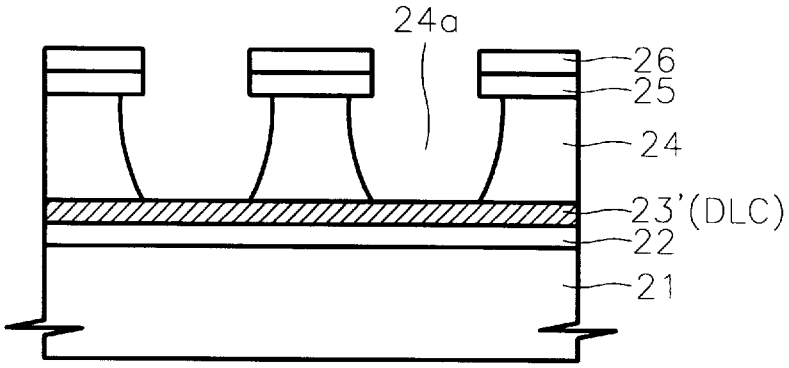

As shown in FIG. 8, the insulating layers 24 having holes 24*a* are formed by etching the insulating layer 24' using an isotropic etching method, in particular, a wet etching method in which a BOE etchant is used. At this time, when the BOE etchant for the wet etching does not easily penetrate into the small holes of the photoresist mask 26, the photoresist mask 26 is etched to half its original thickness (for about one minute) by $O_2$ plasma so that the holes are uniformly enlarged. Accordingly, the etchant easily penetrates into the holes.

Figure 9:
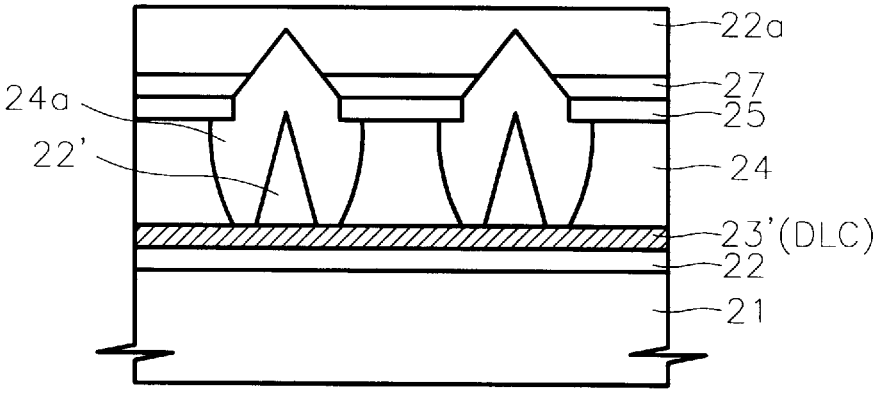
Figure 10:
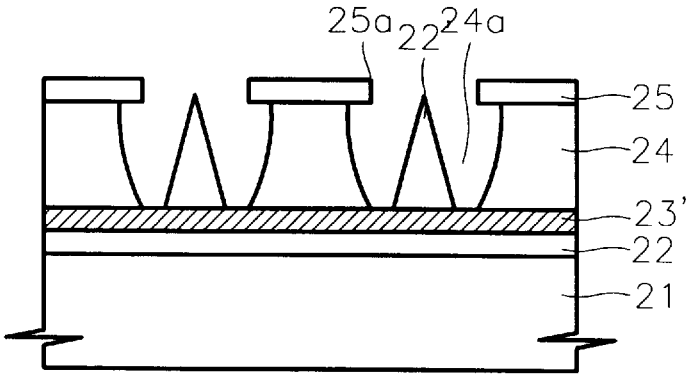

As shown in FIG. 9, an Al split layer 27 is formed on the gates 25. Microtips 22' are formed by depositing Mo 22' and 22*a* on the cathodes exposed by the holes 24*a* through the opening of the split layer 27. The Mo layer 22*a* unnecessarily deposited on the split layer 27 is removed by a lift-off method. Those skilled in the art are capable of removing the Mo layer 22*a* and split layer 27 using the guidelines provided herein. Accordingly, the field emission device using the resistor shown in FIG. 10 is completed.

Figure 11:
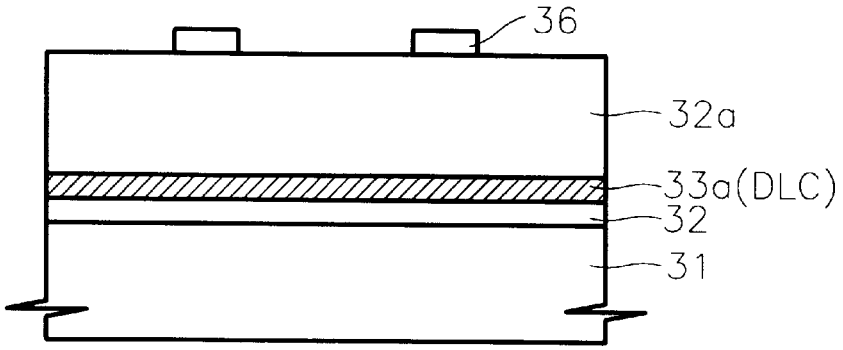

In the second embodiment, as shown in FIG. 11, cathodes 32 in strips are formed on a substrate 31. A resistor layer 33*a* is formed by depositing the DLC on the cathodes 32 by the PECVD method. An Si layer 32*a* for forming microtips is stacked by depositing silicon for forming the microtips on the resistor layer 33*a*. An Al mask 36 for forming the microtips is formed on the Si layer 32*a*. The DLC resistor layer 33*a* is doped with $PH_3$ and thus made up into a resistor having a resistivity of $10^3\Omega\cdot cm$–$10^{11}\Omega\cdot cm$.

Figure 12:
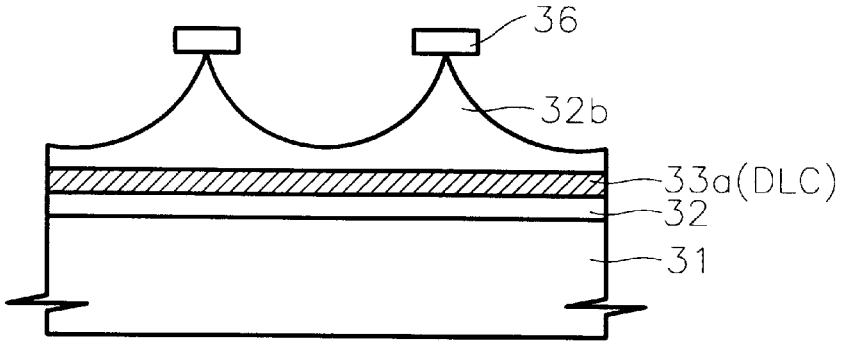
Figure 13:
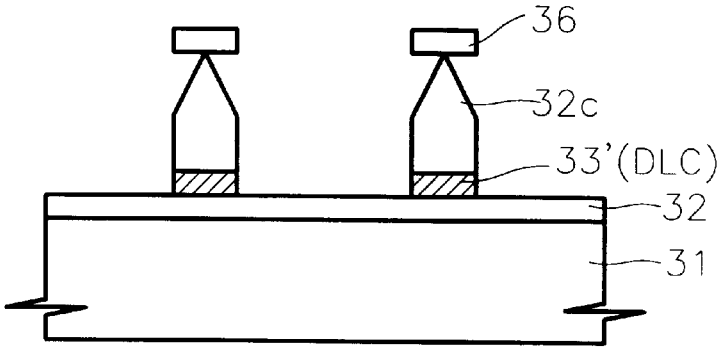

A pointed head 32*b* of the microtip is formed as shown in FIG. 12 by etching the Si layer 32*a* by the isotropic etching method using the Al mask 36. A column 32*c* of the microtip and the resistor layer 33' are formed as shown in FIG. 13 by etching the Si layer 32*a* and the resistor layer 33*a* by the anisotropic method using the Al mask 36.

Figure 14:
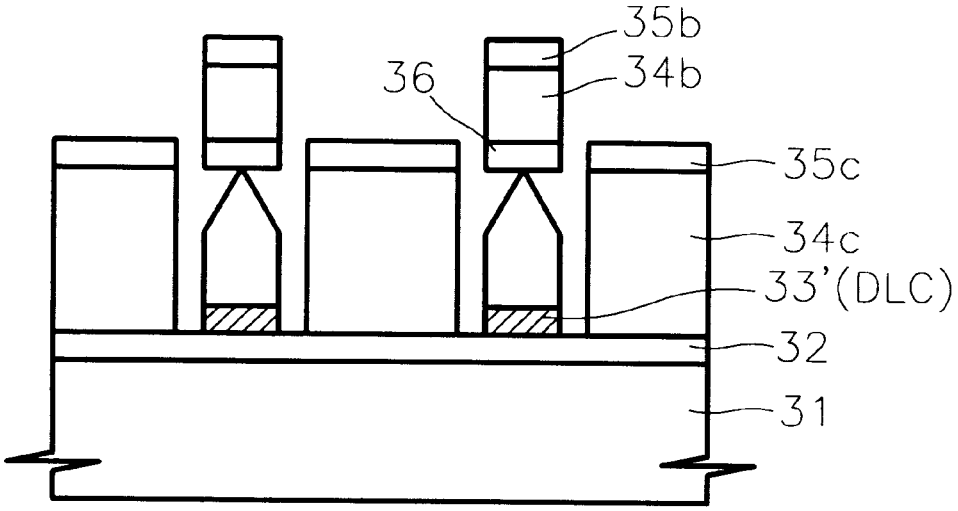
Figure 15:
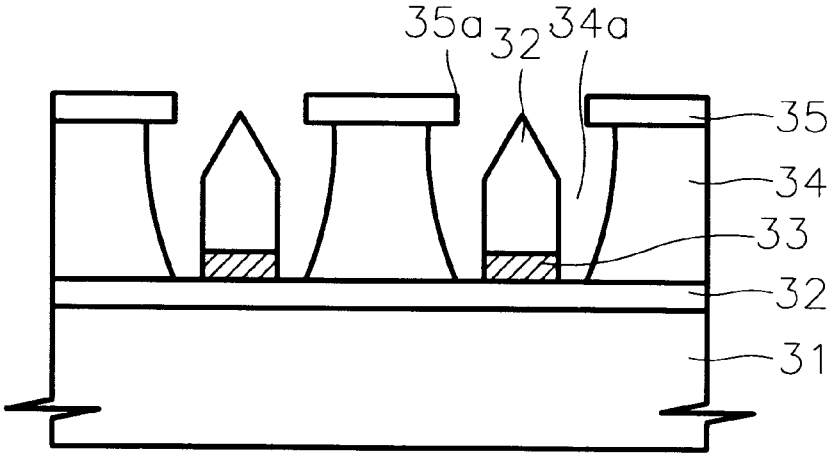

Insulating layers 34*b* and 34*c* and gate layers 35*b* and 35*c* are formed as shown in FIG. 14 by sequentially depositing an insulating material and a gate material on the entire surface. A gate 35 in strips is formed, as shown in FIG. 15, by patterning the gate layer 35*c*. The insulating layer 34*c* is etched after removing the unnecessary insulating layer 34*b* and gate layer 35*b* using the lift-off method (by removing the mask 36). Accordingly, the field emission device having the insulating layer 34 having the hole 34*a* is completed.

As mentioned above, the resistor layer preferably is formed by depositing the DLC on the cathodes by the PECVD method in the field emission device using the resistor according to the present invention. The DLC can be deposited on the cathodes using other known deposition techniques, as long as the DLC so deposited attains good adhesion to the cathodes. In accordance with the invention, fabrication yield is high since the adhesion of the resistor layer to the cathodes is improved. Various types of resistor layers can be formed since the resistor layer has excellent chemical durability. The reliability and reproducibility of the fabrication process is improved since the doping level is easily controlled.

What is claimed is:

1. A field emission device in which resistors are used, comprising:

a substrate;

cathodes formed on the substrate;

a resistor layer continuously formed on the cathodes;

microtips formed on the resistor layer;

an insulating layer formed on the resistor layer and the substrate, including holes corresponding to the microtips, which are spaced from the microtips and surround the microtips; and a gate formed on the insulating layer so as to have openings corresponding to the holes, wherein the resistor layer is formed of diamond like carbon (DLC).

2. The field emission device of claim 1, wherein the DLC has a resistivity of $10^3\Omega\cdot cm–10^{11}\Omega\cdot cm$.

3. The field emission device of claim 1, wherein the resistor layer is discontinuously and locally formed on the cathodes so as to form the lower end columns of the microtips.

4. The field emission device of claim 3, wherein the DLC has a resistivity of $10^3\Omega\cdot cm–10^{11}\Omega\cdot cm$.

5. A method for fabricating a field emission device in which resistors are used, comprising the steps of:

(a) forming cathodes on a substrate;

(b) forming a continuous resistor layer by depositing diamond like carbon (DLC) on the cathodes;

(c) forming an insulating layer and a gate layer by sequentially depositing an insulating material and a gate material on the resistor layer and respectively forming a plurality of holes in the insulating layer and openings the gate layer to form a plurality of gates;

(d) forming microtips by forming a split layer on each of the plurality of gates and the exposed insulating layer and by depositing a material for forming microtips on the exposed cathodes to a predetermined thickness; and (e) removing the unnecessary material for forming microtips deposited in the step (d) by lifting off the split layer.

6. The field emission device of claim 5, wherein the DLC has a resistivity of $10^3\Omega\cdot cm–10^{11}\Omega\cdot cm$ by doping with $PH_3$ in the step (b).

7. The field emission device of claim 5, wherein the step of forming the gate and the holes in the step (c) comprises the steps of:

(c1) forming a photoresist mask on the gate layer;

(c2) forming the openings by etching the gate layer by an anisotropic etching method, using the photoresist mask; and (c3) forming the holes by etching the insulating layer by an isotropic etching method, using the photoresist mask.

8. The field emission device of claim 7, wherein the anisotropic etching method is a reactive ion etching method.

9. The field emission device of claim 7, wherein the isotropic etching method is a wet etching method in which a BOE etchant is used.

10. The field emission device of claim 9, wherein the openings of the mask are widened by etching the photoresist mask by $O_2$ plasma before performing the wet etching method in which the BOE etchant is used.

11. A method for forming a field emission device in which resistors are used, comprising the steps of:

(a) forming cathodes on a substrate;

(b) forming a resistor layer by depositing diamond-like carbon (DLC) on the cathodes;

(c) forming a microtip layer by depositing a material for forming microtips on the exposed substrate and resistor layer;

(d) forming a mask for forming microtips on the microtip layer;

(e) forming a pointed head of the microtip by isotropic etching the microtip layer, using the mask for forming microtips;

(f) forming a column of the microtip and a resistor layer corresponding to the column by sequentially anisotropic etching the microtip layer and the resistor layer, using the mask;

(g) forming a gate by forming an insulating layer and a gate layer by sequentially depositing an insulating material and a gate material on the cathodes and the substrate exposed in the step (f) and patterning the gate layer;

(h) removing the unnecessary insulating material and gate material, deposited on the step (g) by a lift off method used for removing the mask for forming microtips; and (i) forming holes of the insulating layer, using the gate as a mask.

12. The method of claim 11, wherein the DLC has a resistivity of $10^3\Omega\cdot cm–10^{11}\Omega\cdot cm$ by doping with $PH_3$ in the step (b).

13. The method of claim 11, wherein the material for forming the microtips is silicon.

* * * * *